US005472278A

United States Patent [19]

Kawaoka et al.

[11] Patent Number: 5,472,278

[45] Date of Patent: Dec. 5, 1995

[54] STIRRING APPARATUS HAVING BLADES CREATING A CIRCULATING FLOW

[75] Inventors: Takayoshi Kawaoka; Hiroaki Ogasawara; Kenichiro Nakamura; Takafumi Shimada; Setsuo Omoto, all of Hiroshima, Japan

[73] Assignee: Mitsubishi Jukogyo Kabushiki Kaisha, Tokyo, Japan

[21] Appl. No.: 321,233

[22] Filed: Oct. 11, 1994

[30] Foreign Application Priority Data

Oct. 12, 1993 [JP] Japan ..... 5-254145

[51] Int. Cl.[6] ..... B01F 7/20

[52] U.S. Cl. ..... 366/262; 366/307; 366/325.92; 366/329.2

[58] Field of Search ..... 366/64–66, 262–265, 366/307, 325, 327, 329, 379; 416/203; 422/135

[56] References Cited

U.S. PATENT DOCUMENTS

| | | | |
|---|---|---|---|
| 4,125,574 | 11/1978 | Kastner et al. | 422/135 X |
| 4,934,828 | 6/1990 | Janssen | 366/327 X |
| 5,145,255 | 9/1992 | Shimada et al. | 422/135 X |

FOREIGN PATENT DOCUMENTS

| | | | |
|---|---|---|---|
| 047493A1 | 2/1992 | European Pat. Off. . | |
| 3817380A1 | 12/1988 | Germany . | |
| 62-186929 | 8/1987 | Japan | 366/65 |
| 64-69529 | 3/1989 | Japan | 366/65 |

*Primary Examiner*—Charles E. Cooley
*Attorney, Agent, or Firm*—Wenderoth, Lind & Ponack

[57] ABSTRACT

A stirring apparatus includes a container with a rotary stirring shaft therein. On the opposite sides of the rotary stirring shaft are mounted an upper vertical flat blade and first inclined flat blades opposite to each other. A first vertical flat blade has a sweptback blade associated therewith, and is mounted to the stirring shaft at a position under the first inclined flat blades, and a second inclined flat blade or blades and a second vertical flat blade having an associated sweptback blade are mounted to the stirring shaft at a position under the upper vertical flat blade. When the stirring shaft rotates, ascending flows of liquid to be processed along the inner wall within a vessel are generated by the upper vertical flat blade and the first and second vertical flat blades that are each associated with a sweptback blade. Descending flows of the liquid to be processed are generated by the inclined flat blades, thereby enhancing the mixing performance.

5 Claims, 3 Drawing Sheets

STIRRING APPARATUS HAVING BLADES CREATING A CIRCULATING FLOW

BACKGROUND OF THE INVENTION

1. Field of the Invention

The present invention relates to a stirring apparatus for various stirring operations, including mixing and reaction operations, for instance, stirring of a liquid-liquid system of solutions having different viscosities, stirring of a solid-liquid system of slurry-like materials and the like.

2. Description of the Prior Art

Paddle blades, turbine blades, propellor blades, multi-stage paddle blades and the like were equipped in heretofore known stirring apparatuses and used as stirring blades for stirring a fluid having a low viscosity. Helical ribbon blades, screw blades and the like were used for stirring a fluid having a high viscosity.

In the case where a liquid is fed into a stirring vessel filled with another liquid having a different viscosity, and an operation of uniformly mixing two or more kinds of liquids having different viscosities, that is, so-called hetero-viscosity mixing, is carried out by means of the above-described stirring blades in the prior art, however, the problems as described in the following are involved.

(1) If the stirring blades for low-viscosity use (paddle blades, turbine blades, propeller blades, multistage paddle blades and the like) were used, then there were problems in that the mixing performance was poor because the circulation flows of the material to be stirred within a stirring vessel were formed only in the proximity of the stirring blades and circulation flows over the entire space within the vessel could not be formed. Also the power efficiency was poor, because the stirring power has consumed only in the proximity of the stirring blades.

(2) If the stirring blades for high-viscosity use (helical ribbon blades, screw blades and the like) were used, then there were problems in that although the blades revealed an excellent mixing performance for high-viscosity liquids (liquids having a viscosity of several hundreds to several thousands poise or higher), circulation flows over the entire space within the vessel could not be formed for relatively low-viscosity liquids (liquids having a viscosity of several thousands to several hundreds poise or lower), and so the mixing performance was poor. In addition, these types of stirring blades had shortcomings that manufacture was difficult and high in costs and cleaning at the time of stoppage of an operation was not easy because the configurations of the blades were complicated.

SUMMARY OF THE INVENTION

It is therefore one object of the present invention to provide an improved stirring apparatus which is free from the above-described problems in the prior art and which is applicable to the stirring of fluids having a wide range of viscosities.

According to one feature of the present invention, the improved stirring apparatus comprises an upper vertical flat blade mounted on one side of a rotary stirring shaft disposed vertically within a vessel in parallel to the axis of the stirring shaft. A plurality of first inclined flat blades are mounted on the other side of the above-mentioned stirring shaft in the range of the mounting height of the above-mentioned vertical flat blade, at an angle with respect to the axis of the stirring shaft and spaced from one another in order to generate a descending flow. A first vertical flat blade having an associated sweptback blade is positioned under the above-mentioned first inclined flat blades and mounted on the aforementioned stirring shaft in the same orientation as the above-mentioned first inclined flat blades in parallel to the axis of the stirring shaft. One or a plurality of second inclined flat blades are mounted spaced from one another at an angle with respect to the axis of the above-mentioned stirring shaft to generate a descending flow, and a second vertical flat blade also having an associated sweptback blade is mounted in parallel to the axis of the above-mentioned stirring shaft. Both the second inclined and second vertical flat blades are on the above-mentioned stirring shaft in the same orientation as the upper vertical flat blade and are positioned under the above-mentioned upper vertical flat blade in the range of the mounting height of the above-mentioned first vertical blade. The aforementioned upper vertical flat blade, first and second inclined flat blades and first and second vertical flat blades that are each associated with a sweptback blade are disposed so as not to come into contact with the above-mentioned vessel.

According to another feature of the present invention, in the above-featured stirring apparatus, the above-mentioned upper vertical flat blade, first and second inclined flat blades and first and second vertical flat blades are disposed in a range from a bottom surface to the proximity of a level of liquid to be processed within the vessel.

According to still another feature of the present invention, in the above-featured stirring apparatus there are provided baffle plates disposed vertically on the inner wall surface of the vessel.

According to the present invention, due to the above-described arrangement of the upper vertical flat blade, first and second inclined flat blades and first and second vertical flat blades that are each associated with a sweptback blade along the axis of the stirring shaft, as a result of the rotation of the stirring shaft, the following advantages are obtained:

(1) ascending flows are generated in the material to be processed in the proximity of the inner wall surface of the stirring vessel by the upper action of the vertical flat blade, the first and second inclined flat blades and the first and second vertical flat blades that are each associated with a sweptback blade;

(2) descending flows are generated in the material to be processed in the proximity of the center axis of the stirring vessel by the action of the inclined flat blades; and (3) as a result of the above-mentioned phenomena (1) and (2), circulation flows are formed over the entire region within the stirring vessel.

It becomes thereby possible to mix two or more kinds of fluids quickly and efficiently.

Furthermore, owing to the baffle plates disposed vertically on the inner wall surface of the vessel, generation of revolving flows in the inner circumferential direction within the vessel is prevented, and so the formation of ascending flows and descending flows over the entire region within the vessel is promoted.

BRIEF DESCRIPTION OF THE DRAWINGS

The above-mentioned and other objects, features and advantages of the present invention will become more apparent by reference to the following description of one preferred embodiment of the present invention taken in conjunction with the accompanying drawings.

In the accompanying drawings.

DESCRIPTION OF THE PREFERRED EMBODIMENT

Figure 1:
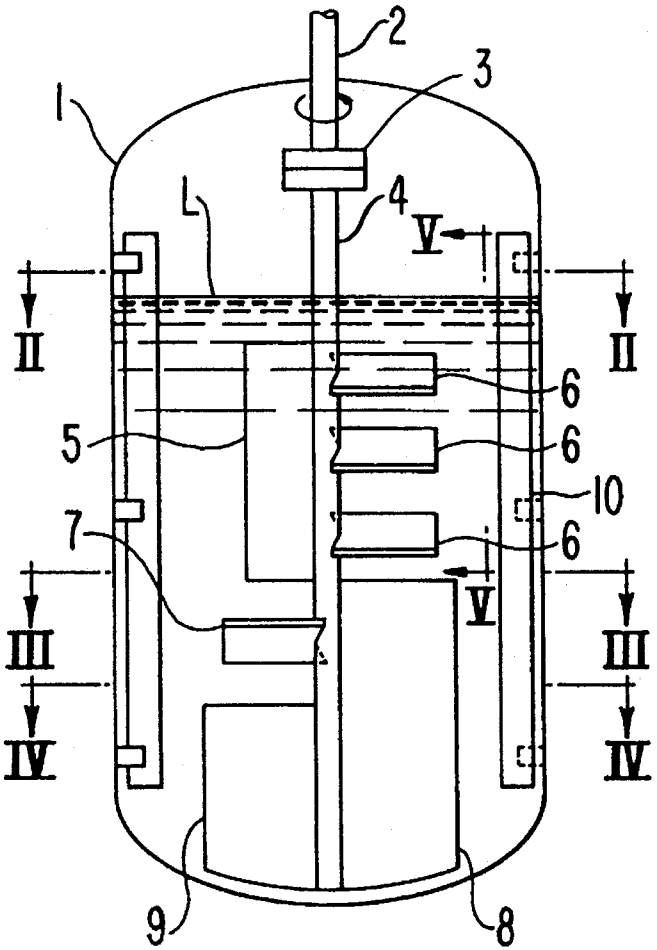
FIG. 1 is a vertical cross-sectional front view of one preferred embodiment of the present invention.
Figure 2:
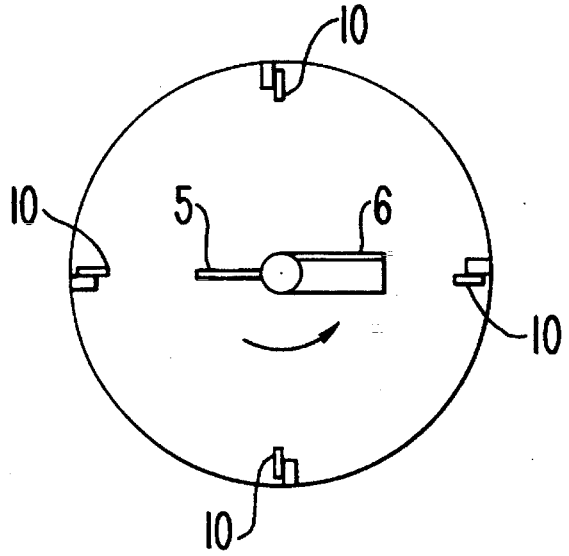
FIG. 2 is a horizontal cross-sectional view taken along line II—II in FIG. 1.
Figure 3:
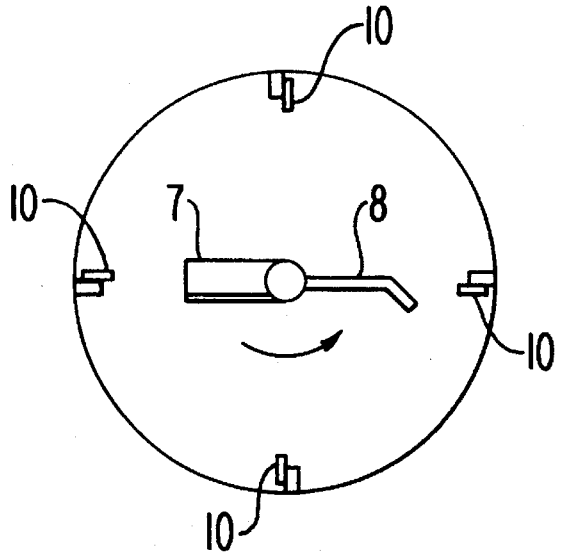
FIG. 3 is another horizontal cross-section view taken along line III—III in FIG. 1.

Now description will be made of one preferred embodiment of the present invention with reference to FIGS. 1 to 6. As shown in FIG. 1, a rotary shaft 2 arranged vertically is inserted into a cylinder-shaped vertical type stirring vessel 1, in which two or more kinds of liquids having different viscosities are accommodated. This rotary shaft 2 is connected via a shaft coupling 3 to a stirring shaft 4 disposed vertically at the central portion of the stirring vessel 1.

Figure 4:
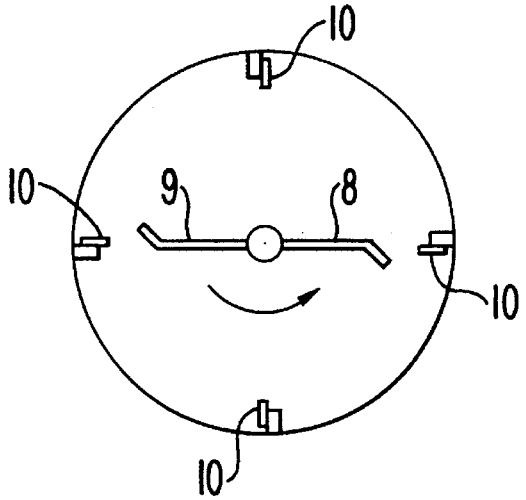
FIG. 4 is still another horizontal cross-section view taken along line IV—IV in FIG. 1.
Figure 5:
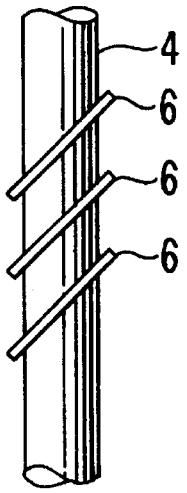
FIG. 5 is a partial cross-section view taken along line V—V in FIG. 1.

On the stirring shaft 4 are disposed an upper vertical flat blade 5, first and second inclined flat blades 6 and 7, and first and second vertical flat blades 8 and 9 each associated with a sweptback blade (i.e. each has a sweptback blade or blade portion on a radially outer end of a radial portion as seen in FIG. 4). The vertical flat blade 5 is mounted on one side of the stirring shaft 4 in parallel to the axis of the stirring shaft 4. In the range of the mounting height of the vertical flat blade 5, on the side opposite to the vertical flat blade 5 on the stirring shaft 4, are mounted a plurality of first inclined flat blades 6 spaced from one another and at an angle with respect to the axis of the stirring shaft 4.

Under the first inclined flat blades 6, the first vertical flat blade 8, associated with a sweptback blade, is mounted on the circumference of the stirring shaft 4 in parallel to its axis at the position in a same orientation as the first inclined flat blades 6. Also, under the vertical flat blade 5, in the range of the mounting height of the first vertical flat blade 8, a second inclined flat blade or blades 7 are mounted on the stirring shaft 4, as spaced from one another and at an angle with respect to the axis of the stirring shaft 4. A second vertical flat blade 9, associated with a sweptback blade, is mounted on the stirring shaft in parallel to its axis. The second inclined flat blade or blades 7 are positioned above the second vertical flat blade 9 and spaced from one another, and both the blades 7 and 9 are positioned on the circumference of the stirring shaft in the same orientation as the vertical flat blade 5.

The above-described first and second inclined flat blades 6 and 7 are disposed in parallel to one another at an equal inclination angle with respect to the axis of the stirring shaft 4 so that descending flows may be generated in the liquid to be processed within the stirring vessel 1 when the stirring shaft 4 rotates (the direction of rotation being indicated by an arrow in FIG. 1). Each of the first and second inclined flat blades have a leading edge leading a trailing edge thereof in the direction of rotation of the shaft 2, with the leading edge being vertically higher than the trailing edge.

The sweptback blades of the above-described first and second vertical flat blades 8 and 9 are formed at the tip end portions of the same blades 8 and 9 and are bent towards the back side with respect to the direction of rotation of the stirring shaft 4. Furthermore, the above-described various blades in the upper region that are and in the lower region disposed in the above-described manner on the stirring shaft 4 and directed in the vertical direction are arranged vertically in a range from a position near the bottom surface up to the proximity of a level L of the liquid to be processed within the stirring vessel 1.

On the inner wall surface of the stirring vessel 1 are provided a plurality of baffle plates 10 directed vertically and extending from the bottom surface of the stirring vessel 1 up to the proximity of an upper limit of the level of the liquid to be processed. These baffle plates 10 have the effects of preventing generation of revolving flows along the inner circumference of the stirring vessel 1 caused by the above-described various stirring blades 5 to 9 at the time of stirring and promoting the formation of ascending flows and descending flows extending over the entire region within the stirring vessel 1.

In the illustrated embodiment, when the stirring shaft 4 is rotationally driven via the rotary shaft 2 within the stirring vessel 1, filled with two or more kinds of liquids having different viscosities, the stirring blades 5 to 9 rotate about the axis of the stirring shaft 4. As a result of the rotation of the vertical flat blade 5 and the first and second vertical flat blades 8 and 9, each associated with a sweptback blade, outward radial flows of the liquids to be processed towards the inner wall surface of the stirring vessel 1 are generated, and these radial flows collide against the inner wall surface of the stirring vessel 1 and become ascending flows along the wall surface of the straight cylinder portion of the stirring vessel 1. These ascending flows become concentric flows towards the center axis of the stirring vessel 1 in the proximity of the level L of the liquids to be processed, and as a result of the rotation of the first and second inclined flat blades 6 and 7 mounted on the stirring shaft 4, they become descending flows in the central portion within the stirring vessel 1.

Accordingly, within the stirring vessel 1 are formed large circulating flows over its entire region, and so, two or more kinds of liquids having different viscosities can be efficiently mixed.

Figure 6:
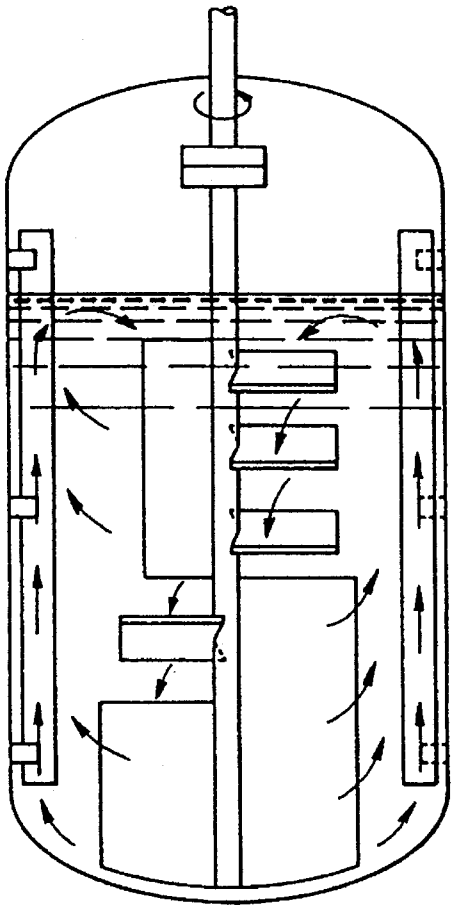
FIG. 6 is an explanatory illustration of flows of material to be processed in the same preferred embodiment.

FIG. 6 shows a state of flows of liquids to be processed within the stirring vessel 1 in the case where two or more kinds of liquids having different viscosities are stirred by making use of the stirring apparatus according to the above-described embodiment of the present invention, and in this figure, the above-described flows of liquids within the stirring vessel 1 are indicated by arrows.

As a result of various experiments conducted by the inventors of this invention, it was proved that in order to achieve highly efficient mixing, preferably the radial dimensions of the first and second vertical flat blades 8 and 9, each associated with a sweptback blade, are chosen to be 50–70% of the radial dimension of the stirring vessel 1. In addition, the bent position of their sweptback blade is preferably chosen to be at a position of 70–80% of their radial dimensions with reference to the axis of the stirring shaft 4. Also it is preferable to choose the radial dimension of the upper vertical flat blade 5 smaller than the radial dimensions of the lower first and second vertical flat blades 8 and 9. It is necessary that the dimensions in the direction of the height of the vertical flat blade 5 and the first and second vertical flat blades 8 and 9 are determined so that the bending moment on the stirring shaft caused by the loads acting upon the respective blades at the time of stirring may be minimized.

In the following, an explanation will be made with respect to experiments conducted by the inventor of this invention, demonstrating the advantages of the stirring apparatus according to the present invention in contrast to the heretofore known stirring apparatus.

Within a stirring vessel of 200 mm in inner diameter and 400 mm in height, and made of transparent acrylic resin, is preliminarily filled 8 liters of a millet jelly solution and an $I_2$ solution having a density $\rho$=1377 kg/m$^3$ and a viscosity $\mu$=2 kg/m·sec. After both solutions have been mixed uniformly, 300 cc of a $Na_2S_2O_3$ solution having a viscosity $\mu$=0.001 kg/m·sec was added, the stirring apparatus was rotated at a rotational speed n= 1–4 rps by making use of various stirring blades, and then a time t (sec) necessitated before the dark brown color of the $I_2$ is decolored by $Na_2S_2O_3$ was measured as a mixing completion time mixing performance data at the time of hetero-viscosity mixing operation of various stirring blades were thereby acquired. In addition, a torque meter was equipped in the driving device for the stirring blades to measure the torque during stirring or mixing operations, and power consumption data of various stirring blades were thereby acquired.

In order to comparatively evaluate mixing performances and power characteristics of various kinds of stirring blades, correlation data of a mixing time t (sec) with respect to power consumption per unit volume $P_v$ (kW/m$^3$) were measured, and the results are shown in Table 1.

TABLE 1

| Shape of Stirring Blades | Outer Diameter of Blades d (mm) | Mixing Time t (sec) $P_v = 0.1$ | $P_v = 0.5$ | $P_v = 1.0$ | $P_v = 2.0$ | $P_v = 3.0$ | $P_v = 5.0$ |
|---|---|---|---|---|---|---|---|
| Stirring Blades shown in FIG. 1 (Blades According to the Present Invention) | 120 | 300 | 20 | 11 | 7.2 | 6.2 | 5.5 |
| Multi-Stage Inclined Paddle Blades (Blades in the Prior Art) | 106.6 | 1700 | 800 | 570 | 410 | 340 | 270 |

From Table-1 above, it has been confirmed that as compared to the stirring blades in the prior art, in the case of the stirring apparatus according to the present invention a mixing time t (sec) for any given power consumption per unit volume $P_v$ (kW/m$^3$) is short, and in the mixing of two or more kinds of liquids having different viscosities as described above, the mixing performance is excellent.

As will be seen from the detailed description of one preferred embodiment of the present invention above, according to the present invention, owing to the improved construction of the stirring apparatus, ascending flows are generated in the proximity of the inner wall surface of a stirring vessel as a result of rotation of a vertical flat blade and first and second vertical flat blades each associated with a sweptback blade, and descending flows are also generated in the proximity of the center axis of the stirring vessel as a result of the rotation of the first and second inclined flat blades. As an effect of these phenomena, circulation flows of material to be processed are formed over the entire region within the stirring vessel, and therefore, in a mixing operation of two or more kinds of liquids having different viscosities, highly efficient stirring can be achieved with low power.

While a principle of the present invention has been described above in connection to one preferred embodiment of the invention, it is intended that all matter described in the specification and illustrated in the accompanying drawings shall be interpreted to be illustrative and not as a limitation to the scope of the invention.

What is claimed is:

1. A stirring apparatus, comprising:

a vessel having an interior for containing a liquid to mixed;

a rotary stirring shaft vertically disposed in said interior of said vessel so as to be rotatable therein, said shaft having an axis;

an upper vertical flat blade mounted on one side of said shaft parallel with said axis of said shaft, said upper vertical flat blade being mounted to said shaft in an upper axial mounting range extending along said shaft;

a plurality of first inclined flat blades mounted on the other side of said shaft in said upper axial mounting range of said upper vertical flat blade at an angle with respect to said axis of said shaft and spaced along said shaft;

a first vertical flat blade mounted on said shaft so as to be positioned below said plurality of first inclined flat blades at a circumferential position on said shaft that is the same as said plurality of first inclined flat blades and parallel with said axis of said shaft, said first vertical flat blade comprising a sweptback blade portion and being mounted to said shaft in a lower axial mounting range extending along said shaft;

at least one second inclined flat blade mounted on said shaft at an angle with respect to said axis; and a second vertical flat blade mounted on said shaft parallel with said axis of said shaft and comprising a sweptback blade portion;

wherein both said at least one second inclined flat blade and said second vertical flat blade are mounted below said upper vertical flat blade at the same circumferential position on said shaft as said upper vertical flat blade and in the lower axial mounting range extending along said shaft; and wherein each of said upper, first and second vertical flat blades and each of said first and said at least one second inclined flat blades are disposed such that no contact takes place between each of said blades and said vessel upon rotation of said shaft.

2. The stirring apparatus of claim 1, wherein said vessel has a predetermined level of liquid to be processed in said vessel, and wherein said upper, first and second vertical flat blades and said first and said at least one second inclined flat blades are disposed so as to range from adjacent to a bottom surface of said interior of said vessel to adjacent to said predetermined level of liquid.

3. The stirring apparatus of claim 2, wherein said interior of said vessel has an inner wall surface provided with a plurality of baffle plates extending vertically along said inner wall surface.

4. The stirring apparatus of claim 1, wherein said interior of said vessel has an inner wall surface provided with a plurality of baffle plates extending vertically along said inner wall surface.

5. A stirring apparatus, comprising:

a vessel having an interior;

a rotary stirring shaft vertically disposed in said interior of said vessel so as to be rotatable therein, said shaft having an axis and a predetermined direction of rotation;

an upper vertical flat blade mounted on one side of said shaft parallel with said axis of said shaft, said upper vertical flat blade being mounted to said shaft in an upper axial mounting range extending along said shaft;

a plurality of first inclined flat blades mounted on the other side of said shaft in said upper axial mounting range of said upper vertical flat blade at an angle with respect to said axis of said shaft and axially spaced along said shaft, said first inclined flat blades having a leading edge leading a trailing edge in the predetermined direction of rotation, said leading edge being vertically higher than said trailing edges;

a first vertical flat blade mounted on said shaft below said plurality of first inclined flat blades at a circumferential position on said shaft that is the same as said plurality of first inclined flat blades and parallel with said axis of said shaft, said first vertical flat blade comprising a radial portion and an angled portion at a radially outer end of said radial portion that angles from said radial portion in a direction generally opposite to said predetermined direction of rotation, and said first vertical flat blade being mounted to said shaft in a lower axial mounting range extending along said shaft;

at least one second inclined flat blade mounted on said shaft at an angle with respect to said axis, said at least one second inclined flat blade having a leading edge leading a trailing edge in the predetermined direction of rotation, said leading edge being vertically higher than said trailing edge; and a second vertical flat blade mounted on said shaft parallel with said axis of said shaft comprising a radial portion and an angled portion at a radially outer end or said radial portion that angles from said radial portion in a direction generally opposite to said predetermined direction of rotation;

wherein both said at least one second inclined flat blade and said second vertical flat blade are mounted below said upper vertical flat blade at the same circumferential position on said shaft as said upper vertical flat blade and in the lower axial mounting range extending along said shaft.

* * * * *